US005727319A

United States Patent [19]

Myerchin et al.

[11] Patent Number: 5,727,319

[45] Date of Patent: Mar. 17, 1998

[54] KNIFE WITH ILLUMINATED BLADE

[76] Inventors: John Myerchin; Angeline Myerchin, both of 850 W. Randall Ave., Rialto, Calif. 92376

[21] Appl. No.: 677,264

[22] Filed: Jul. 9, 1996

[51] Int. Cl.[6] ..... B26B 1/02

[52] U.S. Cl. ..... 30/123; 362/119; 7/118

[58] Field of Search ..... 30/123, 143, 155; 362/119, 120; 7/119, 118

[56] References Cited

U.S. PATENT DOCUMENTS

| | | | |
|---|---|---|---|
| 309,370 | 12/1884 | Wolf . | |
| 1,015,026 | 1/1912 | Jackson et al. | 7/119 |
| 1,127,609 | 2/1915 | Feyrer | 7/119 |
| 1,463,573 | 7/1923 | Champlin | 7/119 |
| 1,890,841 | 12/1932 | Brown . | |
| 1,988,379 | 1/1935 | Gilles | 164/84 |
| 3,370,163 | 2/1968 | Brill | 240/6.46 |
| 3,831,276 | 8/1974 | Dalton et al. | 30/123 R |
| 3,851,986 | 12/1974 | Daughtry | 30/156 |
| 4,085,504 | 4/1978 | Nagy | 30/123 |
| 4,447,950 | 5/1984 | Mizelle | 30/155 |
| 4,657,012 | 4/1987 | Burgin | 128/303.1 |
| 4,669,186 | 6/1987 | Liu | 30/125 |
| 4,751,621 | 6/1988 | Jenkins | 362/119 |
| 4,918,775 | 4/1990 | Leu | 7/168 |
| 5,085,449 | 2/1992 | Hudson | 280/801 |
| 5,313,376 | 5/1994 | McIntosh | 362/119 |
| 5,315,760 | 5/1994 | Emerson | 30/123 |
| 5,402,575 | 4/1995 | Maxcy | 30/123 |
| 5,442,529 | 8/1995 | Hoover | 362/119 |
| 5,459,647 | 10/1995 | Betts | 362/119 |
| 5,467,256 | 11/1995 | Chen | 362/119 |

*Primary Examiner*—Hwei-Siu Payer
*Attorney, Agent, or Firm*—Cislo & Thomas

[57] ABSTRACT

A pocketknife with integral light includes a hollow handle and a cutting blade pivotally connected thereto. The hollow handle at its forward end includes an open compartment containing a battery, connected to an illumination pathway containing an LED electrically connected to the battery. A belt clip covers the open compartment and includes a push button adapted to switch the LED on and off. The open compartment and illumination pathway are sealed to resist moisture and dust from reaching the electrical components. The light from the LED is directed at the tip of a serrated edge of the cutting blade. The device provides the convenience of combining a pocketknife with a light, the light important for the safe use of the cutting blade.

12 Claims, 2 Drawing Sheets

KNIFE WITH ILLUMINATED BLADE

FIELD OF THE INVENTION

The present invention relates generally to cutlery combined with a light, and more particularly to a folding knife having a small integral light, the combination easily carried by the user.

BACKGROUND ART

Knives combined with small lights to illuminate the area around the cutting edge are known in the prior art. Such devices are useful in conjunction with outdoor recreational activities such as camping, hunting, fishing, boating and the like, in the preparation of food after dark, and other similar tasks. It is convenient to have the cutting and lighting functions embodied in a single compact device, whereby the knife may be used safely having proper illumination of the blade and the area surrounding the blade.

Although such existing prior-art devices have proved generally suitable for their intended purposes, they possess inherent deficiencies which detract from their overall effectiveness and desirability. The devices have tended to be heavy and bulky, and not easily carried by the outdoor sportsmen in the field or on the water. The battery and light bulb have typically not been easily accessible for periodic maintenance, including removal and replacement. The battery and light bulb have not typically been protected from the elements, such as moisture and dust. Also, the light has not generally been properly directed at the cutting edge of the blade.

In view of the shortcomings of the prior art, it is desirable to provide a pocketknife conveniently equipped with a small integral flashlight, the device being compact, lightweight and easily carried, and the device configured to provide for a safe cutting operation. It is further desirable that the device offer easy access to electrical components, yet be water- and dust-resistant around the electrical components.

Although the prior art has recognized to a limited extent the problem of providing such a device, the proposed solutions have, to date, been ineffective in providing a satisfactory remedy. By way of example only, U.S. Pat. No. 5,467,256 issued Nov. 14, 1995 to Chen, discloses a pocketknife with a built-in lighting fixture. The device is configured such that the battery cell and light bulb are housed on a supporting plate 21 (see FIG. 3) that is pivotally turnable from the case to an outward position. Chen's device suffers from the disadvantages, however, e.g., the pivoting/turning supporting plate 21 is an extra piece, and the lighting fixture 2 is exposed to the environment.

Applicants' proposed solutions which follow have, to applicants' knowledge, heretofore never been addressed.

SUMMARY OF THE INVENTION

The present invention specifically addresses and alleviates the above-mentioned deficiencies associated with the prior art. More particularly, the present invention comprises a pocketknife with a small integral light, including a hollow handle member adapted for a knife blade movable from a closed position inside the handle to a cutting position protruding from the handle. The handle further has a covered compartment containing a light source, preferably battery powered, and an illumination pathway such that light from the light source may be turned on to illuminate the knife-blade tip and area adjacent.

In a preferred embodiment of the invention, the cover over the battery and light bulb is configured as a belt clip, to additionally facilitate carrying of the pocketknife outside the user's pocket. Also in the preferred embodiment of the invention, a push-button switch is mounted in the belt-clip cover to operate the light source. Additionally, seals are added to the push button, illumination pathway, and belt clip, such that a water- and dust-resistant enclosure is formed around the compartment containing the electrical components. The light source preferably gives off a red- or white-colored light, which may serve as a warning that the knife blade is open. The device may also operate as a tiny flashlight when the pocketknife is closed.

These, as well as other advantages of the present invention, will become more apparent from the following description and drawings. It is understood that changes in the specific structure shown and described may be made within the scope of the claims without departing from the spirit of the invention.

DETAILED DESCRIPTION OF THE INVENTION

The detailed discussion set forth in connection with the appended drawings is intended as a description of the presently preferred embodiment of the invention and is not intended to represent the only form in which the present invention may be constructed or utilized. The discussion sets forth the function and the sequence of steps for constructing and operating the invention in connection with the illustrated embodiment. It is to be understood, however, that the same or equivalent functions and sequences may be accomplished by different embodiments that are also intended to be encompassed within the spirit and scope of the invention.

Figure 1:
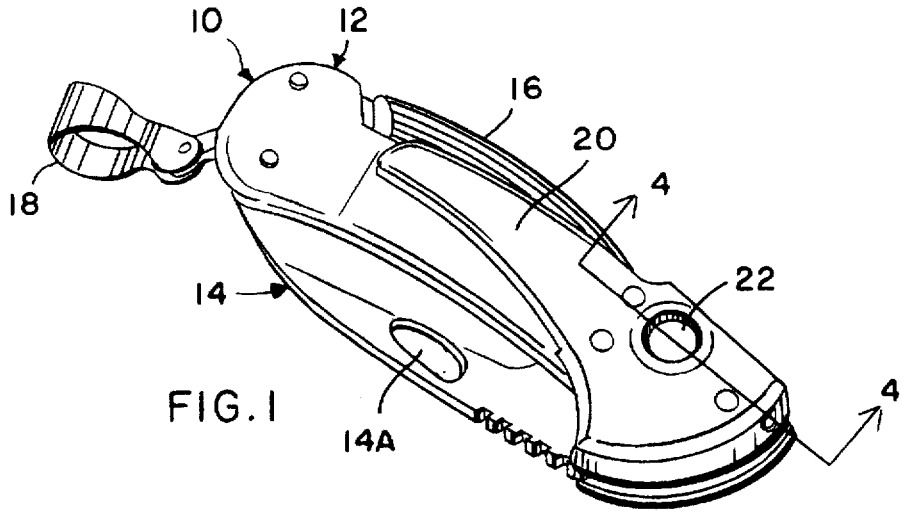
FIG. 1 is a perspective view illustrating an exemplary pocketknife with integral light, a blade shown in a closed position in accordance with the present invention.
Figure 2:
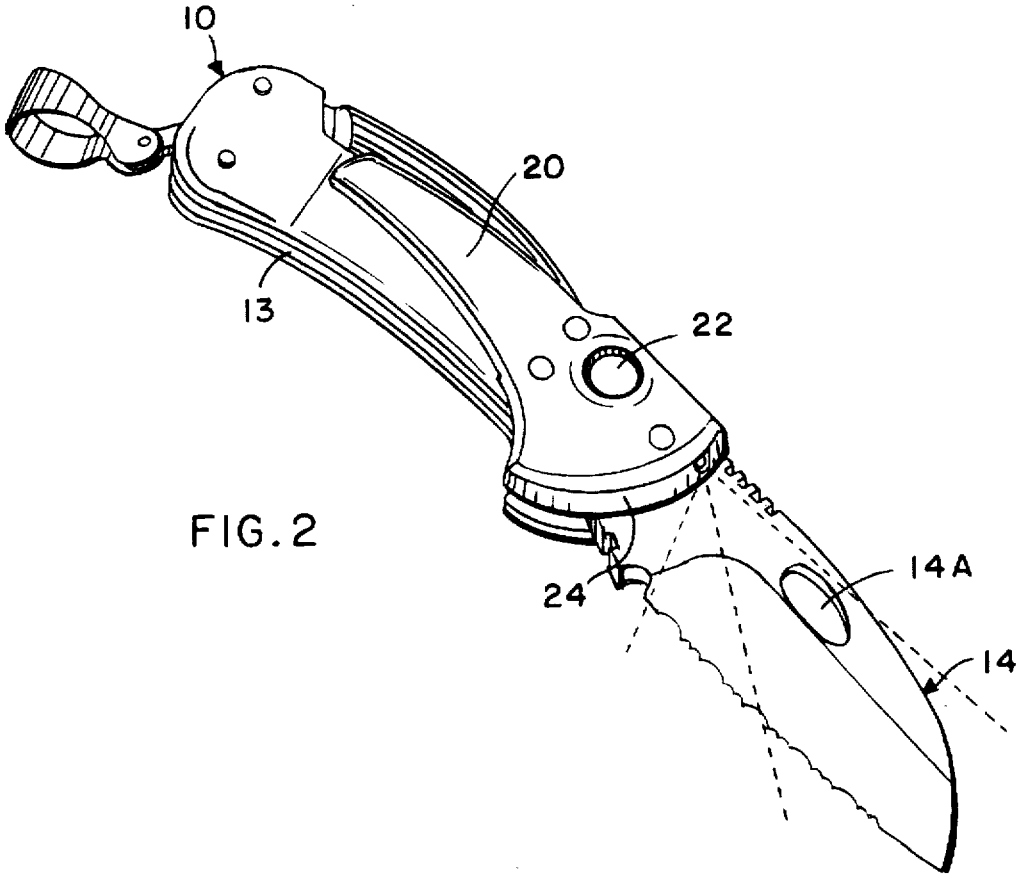
FIG. 2 is a perspective view illustrating the pocketknife with integral light, the blade shown in an open position.

The pocketknife with integral light of the present invention is illustrated in FIGS. 1–4, which depict a presently preferred embodiment of the invention. Referring first to FIGS. 1 and 2, a pocketknife with integral light 10 is comprised generally of a hollow handle member 12 having an opening 13 on at least one side between the two halves of the handle member 12. The device 10 further includes a deployable knife blade 14 with a wedge-shaped shackle opener 14A and a deployable hook/spike implement 16, that deployment controlled, in part, by a lanyard loop 18. The device 10 also preferably includes, attached to the handle member 12, a belt clip 20 that houses a push-button 22 light switch. In FIG. 2, the knife blade 14 is shown pivoted to an open or cutting position, with a collimated beam of light emerging from a forward end 24 of the handle member 12 to illuminate the near side of the knife blade 14.

Figure 3:
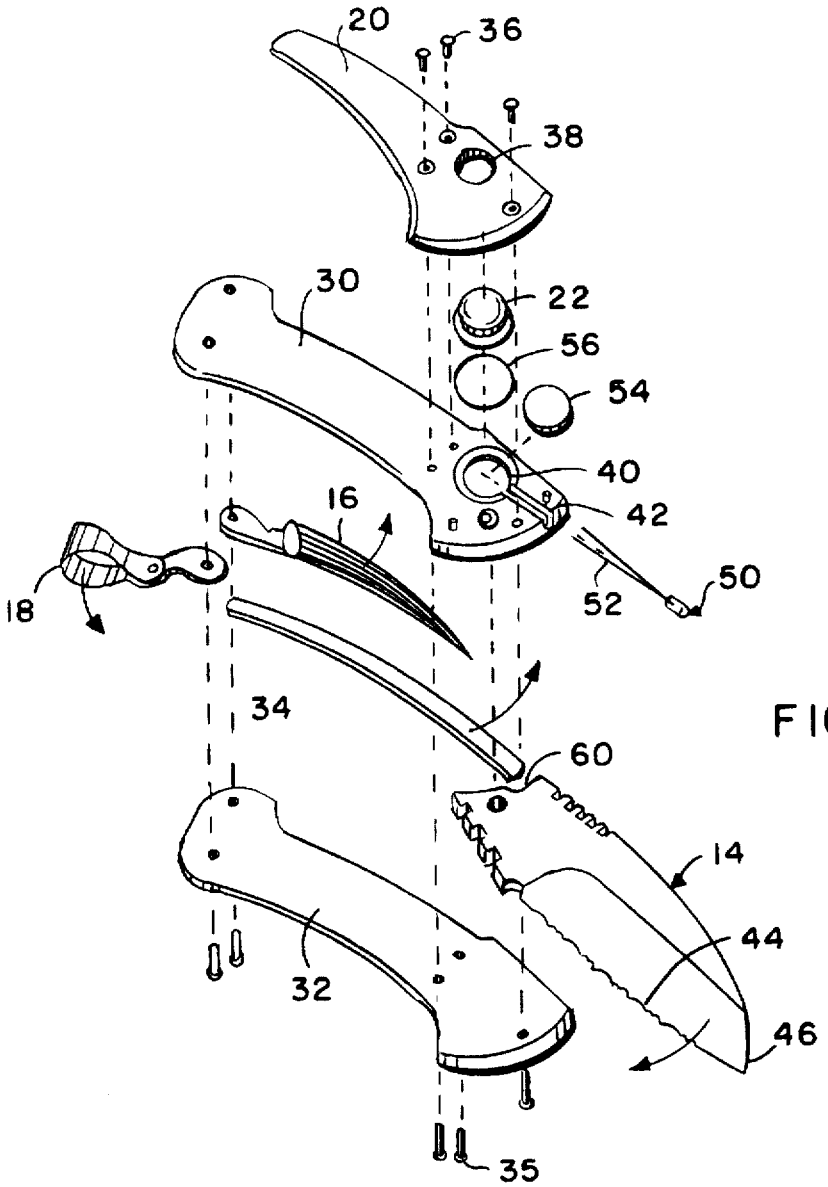
FIG. 3, is an exploded perspective view illustrating various components of the pocketknife with integral light.

Now also referring to FIG. 3, the various structural and mechanical aspects of the device 10 may be described. The top 30 and bottom 32 halves of the handle member 12, the hook/spike implement 16, the lanyard loop 18, a latch member 34, and the knife blade 14 are secured together by standard hardware consisting of five nonremovable pins 35. The knife blade 14, hook/spike implement 16, lanyard loop 18, and latch member 34 are able to pivot in the directions indicated. The belt clip 20 is attached to the top half 30 of the handle member 12 through use of additional standard hardware consisting of three removable screws 36. Also, the belt clip 20 has a circular hole 38 to accommodate the push-button 22 light switch, preferably such that the push button 22 is indented (see FIG. 5) so as not to protrude above the outside surface of the belt clip 20. The top half 30 of the handle member 12 is configured with a cylindrical cavity, or open compartment 40 and a tubular slot, or illumination pathway 42, to house the electrical components of the device 10. The handle member 12 and belt clip 20 are preferably fabricated of molded plastic, offering the advantages of low cost and light weight. The knife blade 14 is preferably fabricated of a fine grade of stainless steel, having a serrated or standard ground cutting edge 44 ground at a standard 20-degree bevel.

Continuing to refer to FIG. 3, the electrical components of the pocketknife with integral light 10 may now be discussed. A small light-emitting diode (LED) 50 is placed in the illumination pathway such that a pair of wires 52 extend into the open compartment 40. The LED 50 is preferably of the type that emits red or white light when electrical current is passed therethrough, such as a conventional LED. Preferably, a small amount of sealant 58 is applied around the LED 50 as it is placed in the illumination pathway 42. A battery 54, such the Eveready® ECR 1216 lithium battery or equivalent, is placed in the open compartment 40 between the pair of wires 52. Over the battery 54 is placed a cushion member 56, which also serves as a seal around the battery 54. The push button 22 light switch is placed over the cushion member 56, and the belt clip 20 is added such that the hole 38 overlies the push button 22.

Referring back to FIGS. 1–3, the operation, function, and use of the preferred embodiment, pocketknife with integral light 10, of the present invention may be described. The knife blade 14 may be deployed from the closed position (FIG. 1) to the open or cutting position (FIG. 2) by simply grasping the knife blade 14 and pivoting it approximately 180 degrees about the forward end 24 of the handle member 12. Upon reaching the cutting position, a cutout aft corner 60 (see FIG. 3) of the knife blade 14 engages the latch member 34, such that the knife blade 14 is locked in place. In utilizing the device 10 for cutting the user may grasp the handle member 12, and with his/her index finger depress the push button 22 thereby switching the LED 50 on. The collimated beam of light coming from the illumination pathway 42 is directed to be centered on the forward tip 46 of the knife blade 14. Returning the knife blade 14 to the closed position, it is necessary to rotate the lanyard 18 (see FIG. 3), thereby causing the latch member 34 also to rotate slightly. This disengages the latch member 34 from the cutout corner 60 of the knife blade 14, thereby allowing the knife blade 14 to pivot back through the opening 13 into the hollow handle member 12. The hook/spike implement 16 operates in a similar fashion except that it is deployed clockwise (see FIG. 3) to project from the aft end of the handle member 12.

Figure 4:
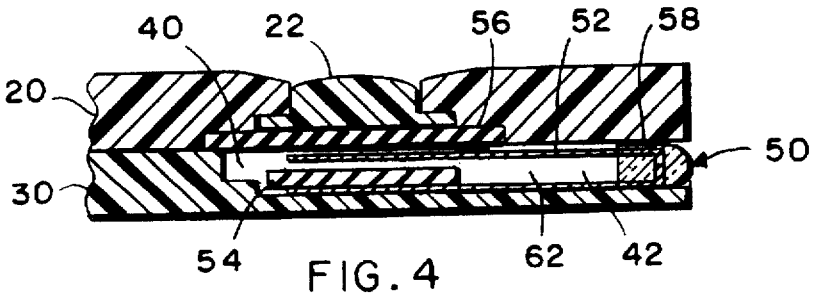
FIG. 4 is a section view illustrating electrical components of the pocketknife with integral light.

Now referring to FIG. 4, the operation of the light switch of the pocketknife with integral light 10 may be discussed. Pressing the push button 22 as shown in FIG. 4 causes compression of the cushion member 56, thereby bringing the wire 52 into contact with the battery 54. This completes the electrical circuit and causes current to flow through the LED 50, thereby sending red light out the illumination path 42. Releasing the push-button switch 22 allows the compressed cushion 56 to return to its normal position, thereby similarly allowing the wire 52 to move away from the battery 54 and opening the circuit. The stoppage of current flow causes the LED 50 to go dark. Alternatively, a conventional single -pole, double throw switch (not shown) could have instead been utilized, where each electrical contact established by the push button 22 is operative to switch the LED off to on, or on to off whichever the case may be.

It is understood that the KNIFE WITH ILLUMINATED BLADE described herein and shown in the drawings represents only a presently preferred embodiment of the invention. Indeed, various modifications and additions may be made to the preferred embodiment without departing from the spirit and scope of the invention. These and other modifications and additions may be obvious to those skilled in the art and may be implemented to adapt the present invention for use in a variety of different applications.

What is claimed is:

1. A pocketknife with integral light comprising:

a hollow handle member;

a knife blade movably connected to said hollow handle member, such that said knife blade is movable from a closed position substantially inside the handle member to a cutting position outside the handle member;

the handle member having an open compartment containing a power source;

the handle member further having an illumination pathway connected to said open compartment, said illumination pathway containing a light source electrically connected to said power source;

the illumination pathway configured such that light from said light source may illuminate a portion of the knife blade in the cutting position and illuminate an area adjacent said portion of the knife blade; a cover removably attached over the open compartment;

a latch member movably attached to the handle member, movable to fixedly engage the knife blade in the cutting position thereby locking the knife blade in place; and, a lanyard attached to said latch member, for causing disengagement of said latch member from the knife blade.

2. A pocketknife with integral light comprising:

a hollow handle member;

a knife blade movably connected to said hollow handle member, such that said knife blade is movable from a closed position substantially inside the handle member to a cutting position outside the handle member;

the handle member having an open compartment containing a power source;

the handle member further having an illumination pathway connected to said open compartment, said illumination pathway containing a light source electrically connected to said power source;

the illumination pathway configured such that light from said light source may illuminate a portion of the knife blade in the cutting position and illuminate an area adjacent said portion of the knife blade; and, a cover removably attached over the open compartment, said cover in the form of a belt clip.

3. The pocketknife with integral light of claim 2, further comprising a push-button mounted in said belt clip, to electrically connect and disconnect the power source to the light source to operate the light.

4. The pocketknife with integral light of claim 3, further comprising:

a seal between said push-button and the belt clip;

a seal between the light source and the illumination pathway; and a seal between the belt clip and the handle member;

whereby a substantially watertight enclosure is formed around the open compartment.

5. The pocketknife with integral of light of claim 2 wherein the light source is a light-emitting diode.

6. The pocketknife with integral light of claim 2 wherein the light source emits a red or white light, to also act as a warning that the knife blade is in the cutting position.

7. The pocketknife with integral light of claim 2 wherein the knife blade is pivotally connected to the handle member such that the knife blade is pivotable between the closed position and the cutting position.

8. The pocketknife with integral light of claim 7, further comprising a hook/spike implement pivotally connected to an aft end of the handle member.

9. The pocketknife with integral light of claim 8 wherein the hook/spike implement is pivotable from alongside an edge of the handle member to a second cutting position with the hook/spike member projecting aft from the handle member.

10. The pocketknife with integral light of claim 2 wherein said illumination pathway is configured such that said light from said light source is approximately centered on a cutting edge of the knife blade.

11. The pocketknife with integral light of claim 10 wherein the illumination pathway is configured such that the light from said light source is approximately centered on a tip of said cutting edge of the knife blade.

12. The pocketknife with integral light of claim 2 wherein the illumination pathway is configured such that light from the light source illuminates an area forward of the handle member when the knife blade is in the closed position.

* * * * *